US011833570B2

(12) United States Patent
Sato

(10) Patent No.: US 11,833,570 B2
(45) Date of Patent: Dec. 5, 2023

(54) METHOD FOR MANUFACTURING SHAPED PART

(71) Applicant: NIPPON STEEL CORPORATION, Tokyo (JP)

(72) Inventor: Masahiko Sato, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/043,382

(22) PCT Filed: Mar. 29, 2019

(86) PCT No.: PCT/JP2019/014320
§ 371 (c)(1),
(2) Date: Sep. 29, 2020

(87) PCT Pub. No.: WO2019/189873
PCT Pub. Date: Oct. 3, 2019

(65) Prior Publication Data

US 2021/0023600 A1 Jan. 28, 2021

(30) Foreign Application Priority Data

Mar. 30, 2018 (JP) ..... 2018-068710

(51) Int. Cl.
*B21D 5/01* (2006.01)

(52) U.S. Cl.
CPC ..... *B21D 5/01* (2013.01)

(58) Field of Classification Search
CPC . B21D 5/01; B21D 5/10; B21D 5/015; B21D 22/025; B21D 31/005; B21D 37/08; B21D 35/001; B21D 35/002
See application file for complete search history.

(56) References Cited

U.S. PATENT DOCUMENTS 1,972,294 A * 9/1934 Fantz ..... B21C 37/28 285/179
2001/0013242 A1* 8/2001 Kondou ..... B21C 37/104 72/379.2

(Continued)

FOREIGN PATENT DOCUMENTS

JP 57-165120 A 10/1982
JP 58-32010 A 2/1983

(Continued)

*Primary Examiner* — Debra M Sullivan
*Assistant Examiner* — Matthew Stephens
(74) *Attorney, Agent, or Firm* — Birch, Stewart, Kolasch & Birch, LLP

(57) ABSTRACT

The present invention has as its object to provide a method for manufacturing a shaped part able to suppress the occurrence of shaping defects when manufacturing a tubular shaped part. The above object is achieved by providing a method for manufacturing a shaped part comprising a first bending process of press-forming a metal sheet to obtain a curved intermediate part curved in a longitudinal direction by a curvature α, a U-process of press-forming the curved intermediate part into an approximately U-section to obtain a first curved U-section intermediate part provided with a bottom part having the curvature α, and an O-process of press-forming the first curved U-section intermediate part to form a closed cross-section to obtain a tubular shaped part provided with a bottom part having the curvature α.

4 Claims, 18 Drawing Sheets

(56) References Cited

U.S. PATENT DOCUMENTS

| | | | | |
|---|---|---|---|---|
| 2007/0175261 | A1 | 8/2007 | Hornig et al. | |
| 2015/0151344 | A1* | 6/2015 | Ueno | B21K 7/12 72/51 |
| 2015/0165503 | A1* | 6/2015 | Shinmiya | B21D 37/16 72/51 |
| 2016/0325330 | A1* | 11/2016 | Nitta | B21D 22/26 72/51 |
| 2017/0159538 | A1* | 6/2017 | Nakagawa | B21D 5/10 72/51 |
| 2017/0232492 | A1* | 8/2017 | Isogai | B21C 37/08 72/51 |
| 2017/0274434 | A1 | 9/2017 | Sato et al. | |
| 2018/0281044 | A1* | 10/2018 | Fortmeier | C21D 9/00 72/379.2 |
| 2020/0114408 | A1* | 4/2020 | Fortmeier | B21D 22/06 72/51 |
| 2020/0238355 | A1* | 7/2020 | Tobita | B21D 22/26 72/51 |

FOREIGN PATENT DOCUMENTS

| | | | | |
|---|---|---|---|---|
| JP | 3114918 | B2 | 12/2000 | |
| JP | 2008-80381 | A | 4/2008 | |
| JP | 2010-64138 | A | 3/2010 | |
| JP | 2010126095 | A * | 6/2010 | B21D 53/88 |
| JP | 2017-192978 | A | 10/2017 | |
| WO | WO 2005/002753 | A1 | 1/2005 | |
| WO | WO 2016/043280 | A1 | 3/2016 | |
| WO | WO-2016043280 | A1 * | 3/2016 | B21C 37/16 |

* cited by examiner

METHOD FOR MANUFACTURING SHAPED PART

FIELD

The present invention relates to a method for manufacturing a shaped part using a metal sheet.

BACKGROUND

Curved tubes having curved shapes, different diameter tubes with different outside diameters in the longitudinal direction, different cross-section tubes with different cross-sectional shapes in the longitudinal direction, and other tubular shaped parts are frequently used for automobile parts and home electrical appliances. Development of art for manufacturing such tubular shaped parts is being promoted.

In the past, in manufacturing tubular shaped parts, UO-forming has been performed mainly for straight shaped thick wall large diameter tubes. For example, PTL 1 discloses art successively performing C-pressing, U-pressing, and O-pressing to form a straight shaped steel tube. However, with conventional UO-forming, it is difficult to form a curved tube or a different diameter tube or different cross-section tube.

In recent years, art has been developed for improving UO-forming to form tubular shaped parts having three-dimensional shapes such as curved tubes, different diameter tubes and different cross-section tubes. For example, PTL 2 proposes a method using a die set provided with guide blades for vertical direction end part use for UO-forming to manufacture a straight shaped different diameter tube. Further, PTL 3 and PTL 4 propose methods for manufacturing curved hollow tubes, the method comprising bending in the longitudinal direction at the time of U-forming where the U-forming process includes drawing. Further, PTL 5 proposes a method for manufacturing a tubular shaped part, the method comprising bending in a longitudinal direction after U-forming.

CITATIONS LIST

Patent Literature

[PTL 1] Japanese Unexamined Patent Publication No. S58-32010

[PTL 2] WO2005/002753

[PTL 3] Japanese Patent No. 3114918

[PTL 4] Japanese Unexamined Patent Publication No. 2008-80381

[PTL 5] WO2016/043280

SUMMARY

Technical Problem

However, the method described in PTL 2 is a method for manufacturing a straight shape different diameter tube. It is difficult to form a curved tube. The methods described in PTL 3 and PTL 4 actually include a large number of processes and are low in yield. Further, in the prior arts described in PTL 5 etc., further suppression of cracks, wrinkles, and other shaping defects during bending work is desired.

In this way, a method for manufacturing a shaped part able to manufacture a tubular shaped part of a curved tube, different diameter tube, or different cross-section tube, high in yield, and able to suppress shaping defects has been desired.

Solution to Problem

The gist of the present disclosure is as follows:

(1) A method for manufacturing a shaped part comprising:

a first bending process of press-forming a metal sheet to obtain a curved intermediate part curved in a longitudinal direction by a curvature $\alpha$, a U-process of press-forming the curved intermediate part into an approximately U-section to obtain a first curved U-section intermediate part provided with a bottom part having the curvature $\alpha$, and an O-process of press-forming the first curved U-section intermediate part to form a closed cross-section to obtain a tubular shaped part provided with a bottom part having the curvature $\alpha$.

(2) The method for manufacturing a shaped part according to the above (1) further comprising, between the U-process and the O-process, a second bending process of bending the first curved U-section intermediate part provided with the bottom part having the curvature $\alpha$ obtained by the U-process, by press-forming in the same direction as the direction in which the bottom part of the first curved U-section intermediate part bends in the longitudinal direction to obtain a second curved U-section intermediate part provided with a bottom part having a curvature $\beta$ curved in the longitudinal direction and press-forming the second curved U-section intermediate part in the O-process so as to form a closed cross-section to obtain a tubular shaped part provided with a bottom part having the curvature $\beta$.

(3) The method for manufacturing a shaped part according to the above (2) wherein a ratio $\alpha/\beta$ of the curvature $\alpha$ of the first curved U-section intermediate part with respect to the curvature $\beta$ of the second curved U-section intermediate part is 0.5 to 0.8.

(4) The method for manufacturing a shaped part according to any one of the above (1) to (3) further comprising imparting a compressive force in a sheet thickness direction to vertical wall parts of the approximately U-section in at least one of the U-process and the second bending process.

(5) The method for manufacturing a shaped part according to any one of the above (1) to (4) wherein the direction in which the bottom part of the first curved U-section intermediate part bends in the longitudinal direction projects to the inside of the first curved U-section intermediate part.

Advantageous Effects

According to the present disclosure, it is possible to provide a method for manufacturing a shaped part able to manufacture a tubular shaped part of a curved tube, different diameter tube, or different cross-section tube, high in yield, and able to suppress shaping defects.

DESCRIPTION OF EMBODIMENTS

Figure 1A:
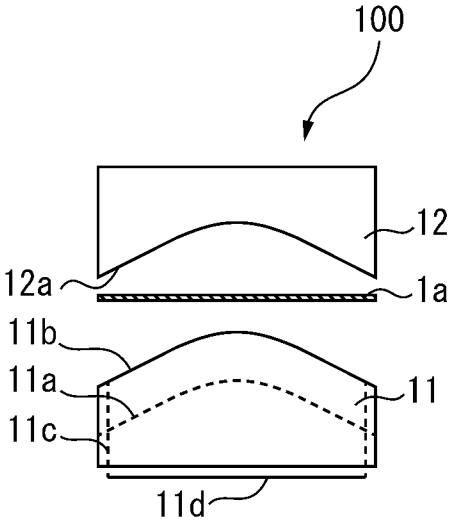
FIGS. 1A to 1D are process diagrams showing one example of a first bending process in a method for manufacturing a shaped part of the present invention.

Below, embodiments of the method for manufacturing a shaped part of the present invention will be explained while referring to the drawings.

The method for manufacturing a shaped part of the present invention includes mainly two embodiments. Below, the explanation will be given divided into the embodiments.

1. First Embodiment

The method for manufacturing a shaped part of the first embodiment is characterized by comprising a first bending process of press-forming a metal sheet to obtain a curved intermediate part curved in a longitudinal direction by a curvature α, a U-process of press-forming the curved intermediate part into an approximately U-section to obtain a first curved U-section intermediate part provided with a bottom part having the curvature α, and an O-process of press-forming the first curved U-section intermediate part to form a closed cross-section to obtain a tubular shaped part provided with a bottom part having the curvature α.

According to the method for manufacturing the first embodiment, it is possible to bend the metal sheet in the longitudinal direction before shaping it into a U-section to thereby suppress shaping defects at the bottom part of the U-section.

First Bending Process

With the first bending process in the method for manufacturing a shaped part of the first embodiment, a metal sheet is shaped to obtain a curved intermediate part curved in the longitudinal direction by a curvature α. As the shaping method, press-forming is preferable, but the method is not particularly limited so long as able to shape a metal sheet by curving it in the longitudinal direction.

Figure 1B:
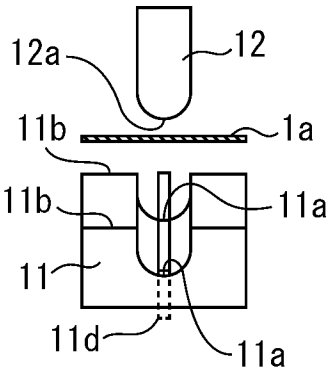
Figure 1C:
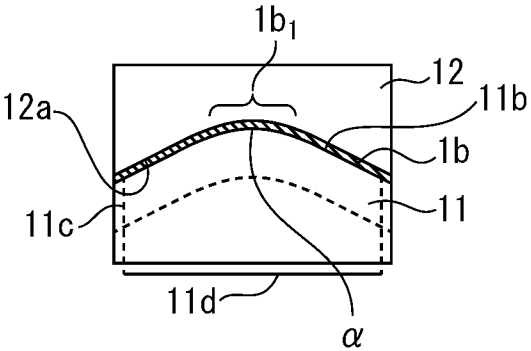
Figure 1D:
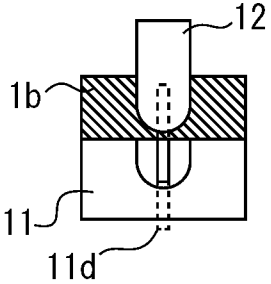

FIGS. 1A to 1D are process diagrams showing one example of the first bending process. FIGS. 1A and 1C are front views, FIG. 1B is a side view of FIG. 1A, and FIG. 1D is a side view of FIG. 1C.

Figure 17:
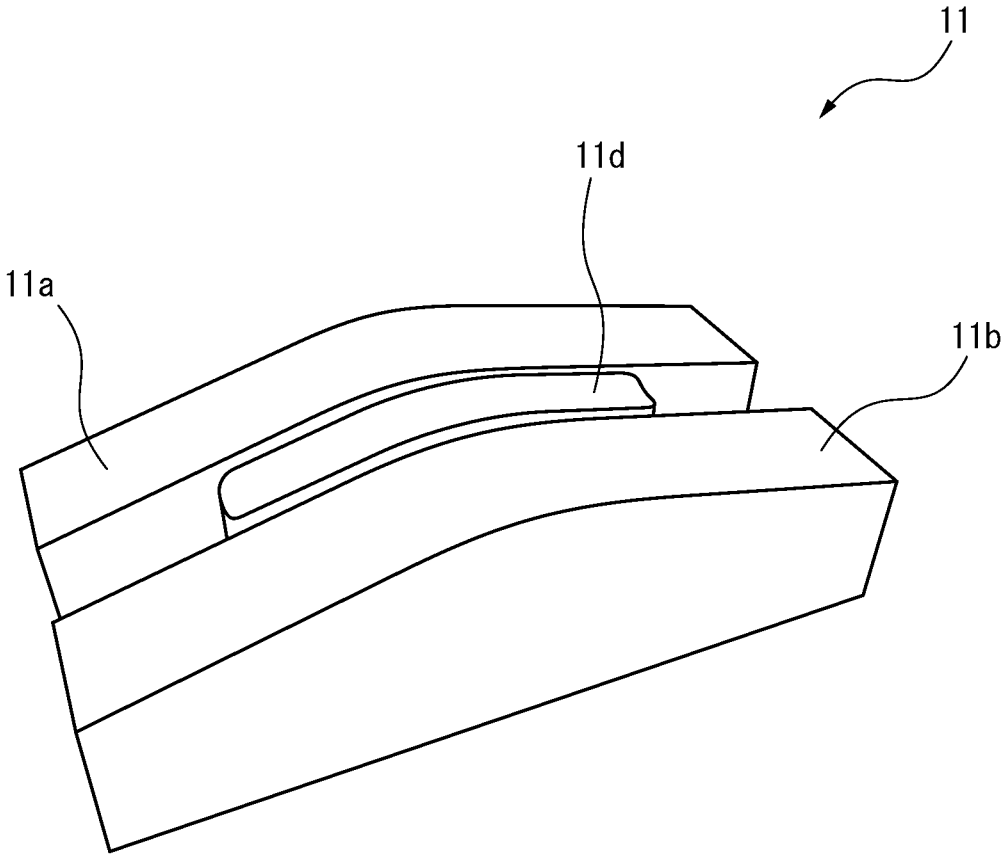
FIG. 17 is a schematic perspective view of a first die set.

In the first bending process, as shown in FIGS. 1A and 1B, a first die set 100 is prepared. FIG. 17 shows a perspective view of the first die set 100. The first die set 100 has a die 11 and a punch 12. A bottom part 11*a* of a concaved part of the die 11, a top surface 11*b* of the die 11, and a bottom part 12*a* of the punch 12 are all formed curved in the longitudinal direction.

The die 11 preferably has a support part 11*d* arranged at the bottom part of the die 11 and able to move in the top-down direction. The support part 11*d* is supported from below by a not shown load source. The load source is not particularly limited, but a hydraulic cylinder, spring, gas cushion, etc. can be used.

A metal sheet 1*a* can be placed between the die 11 and punch 12 of the first die set 100 and, as shown in FIGS. 1C and 1D, clamped by the top surface 11*b* of the die 11 and the bottom part 12*a* of the punch 12 of the first die set so as to make the metal sheet 1*a* curve. Due to this, a curved intermediate part 1*b* curved in the longitudinal direction by a curvature α such as shown in FIGS. 1C and 1D is obtained. The "curvature" in the present application is a reciprocal of a radius of curvature in the longitudinal direction at the front surface of the inner side of the curved part (bent part) of the metal sheet. The "bent part" in the present application shows the part bent in the longitudinal direction of the metal sheet by a first bending process or a second bending process in the later explained second embodiment. The curvature α is calculated as a reciprocal of a radius of curvature calculated from the curve shown by the surface of the inner side (die 11 side) of the bent part $\mathbf{1}b_1$ in the cross-sectional view of the longitudinal direction shown in FIG. 1C.

Preferably, the metal sheet 1*a* is clamped by the top surface 11*b* of the die 11 and the bottom part 12*a* of the punch 12 of the first die set and supported by the support part 11*d* while making the metal sheet 1*a* curve. Due to this, it is possible to control the curvature α better. When making the metal sheet 1*a* curve, the support part 11*d* may move according to the load by which the metal sheet 1*a* is pushed to the bottom part 12*a* side of the punch 12 to an extent where the metal sheet 1*a* does not plastically deform into an approximately U-section.

The metal sheet is not particularly limited so long as able to be shaped. For example, a hot rolled steel sheet, cold rolled steel sheet, plated steel sheet, etc. can be used. As the metal sheet, one comprised of a plurality of metal sheets pieced together, a so-called "tailored blank", may be used. As the metal sheet, a differential thickness steel sheet may also be used. As the metal sheet, one comprised of a plurality of metal sheets stacked together or one comprised of a nonmetal blank laid over a metal sheet, a so-called laminated sheet, may also be used.

The material of the metal sheet is not particularly limited so long as able to be shaped. Examples may include an Fe-based one, Al-based one, Cu-based one, Ti-based one, or other material.

The thickness of the metal sheet need only be one of an extent enabling the sheet to be shaped. It differs according to the material or the shape etc. of the shaped part, but for example is preferably in the range of 1.0 to 5.0 mm. If the sheet is too thin, at the time of bending, wrinkles or cracks are liable to be caused at the bent part. Further, if the sheet is too thick, an excessive load may be required for shaping.

Figure 2E:
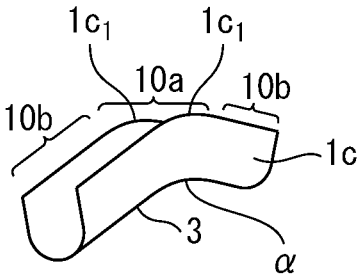
FIGS. 2E and 2E' are process diagrams showing one example of a U-process in a method for manufacturing a shaped part of the present invention.
Figure 2E:
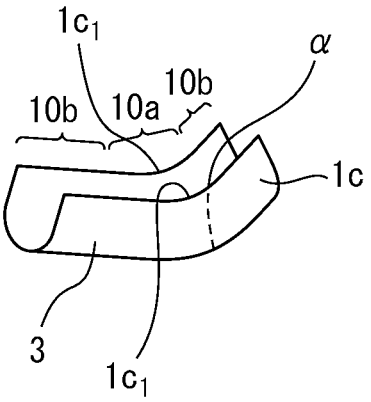
Figure 8:
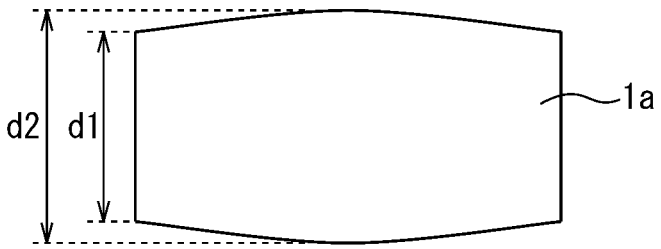
FIG. 8 is a schematic plan view showing one example of a metal sheet used for a method for manufacturing a shaped part of the present invention.

The shape of the metal sheet is suitably adjusted in accordance with the shape of the shaped part. For example, when shaping the metal sheet so that the cross-section vertical to the longitudinal direction becomes a U-section, the length of the U-section at the bent part increases or decreases from the length of the width of the metal sheet before shaping so as to give the U-section. For this reason, the width of the sheet of the region forming the bent part of the metal sheet may be designed as a length different from the length of the U-section of the targeted first curved U-section intermediate part. For example, if preparing a first curved U-section intermediate part 1*c* such as shown in FIG. 2E provided with a bent part 10*a* having a curvature α and a straight part 10*b*, the width d2 of the region becoming the bent part of the metal sheet 1*a* may be designed broader than the widths d1 of the regions becoming the straight part as shown in FIG. 8. The "straight part" in the present application shows the part not bent in the longitudinal direction of the metal sheet, that is, the part where the curvature in the longitudinal direction does not change, in the first bending process or the second bending process in the later explained second embodiment.

The curved intermediate part 1*b* obtained in the first bending process is curved in the longitudinal direction. In the width direction of the curved intermediate part 1*b*, the cross-section is formed in a straight shape.

U-Process

In the U-process, as shown in FIG. 2E, the curved intermediate part 1*b* obtained at the first bending process is shaped into an approximately U-section to obtain the first curved U-section intermediate part 1*c* having a bottom part curved in the longitudinal direction.

In the U-process, press-forming is used. The U-process is not particularly limited so long as using a die set giving the first curved U-section intermediate part, but it is possible to use the first die set 100 used in the first bending process. The curved intermediate part 1*b* is placed between the die 11 and punch 12 of the first die set 100, the concaved part of the die 11 and the punch 12 is used to press-form the curved intermediate part 1*b* into an approximately U-section, and the first curved U-section intermediate part 1*c* such as shown in FIG. 2E is obtained. FIG. 2E is a perspective view of the first curved U-section intermediate part 1*c* obtained in the U-process.

When press-forming the curved intermediate part 1*b* into an approximately U-section in the U-process, the curved intermediate part 1*b* is preferably in a state held between the bottom part 12*a* of the punch 12 and the support part 11*d* of the die 11. Due to this, the curvature α of the curved intermediate part 1*b* can be excellently maintained in the first curved U-section intermediate part 1*c*.

The first curved U-section intermediate part 1*c* is formed with the bottom part 3 curved in the longitudinal direction. The "bottom part 3 of the first curved U-section intermediate part 1*c*" in the present application shows the curved region at the opposite side from the edge parts $1c_1$ between the two edge parts $1c_1$ in the cross-section cutting the first curved U-section intermediate part 1*c* vertical to the longitudinal direction. The first curved U-section intermediate part 1*c* has a bent part 10*a* with a bottom part 3 curved in the longitudinal direction and a straight part 10*b* with a bottom part 3 extending in straight shapes in the longitudinal direction and with length in the approximately U-section equal along the center axis.

The radius of curvature in the longitudinal direction at the surface at the inner side of the bent part 10*a* of the first curved U-section intermediate part 1*c* differs according to the material or shape of the shaped part etc., but can preferably be set within the range of 2.5 to 10 times the width of the U-section. If the lower limit of the radius of curvature is within the preferable range, it is possible to better keep wrinkles or cracks from occurring at the bent part due to the U-process. If the upper limit of the radius of curvature is within the above range, the effect of bending in the longitudinal direction before shaping into the U-section can be more stably obtained. Here, the "width of the U-section" indicates the width W over which the inside surfaces of the first curved U-section intermediate part 1*c* face each other such as shown in for example FIG. 3G.

Figure 16A:
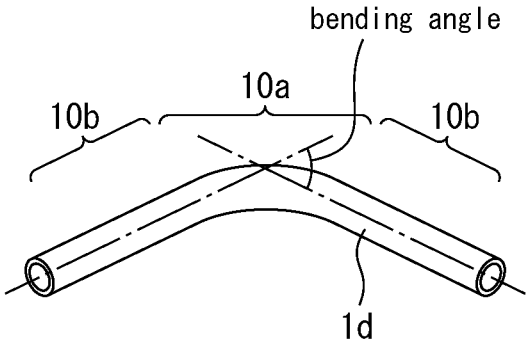
FIGS. 16A to 16F are schematic perspective views showing other examples of a tubular shaped part of the present invention.
Figure 16B:
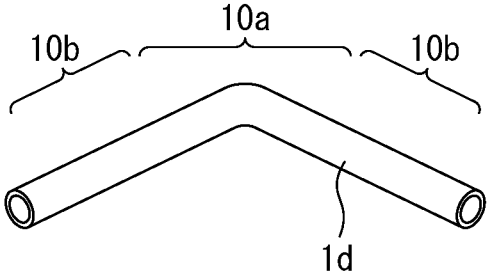
Figure 16C:
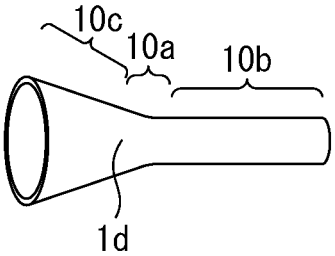
Figure 16D:
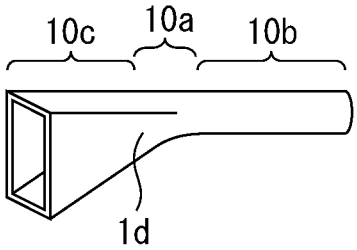
Figure 16E:
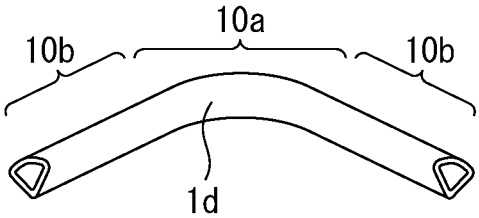
Figure 16F:
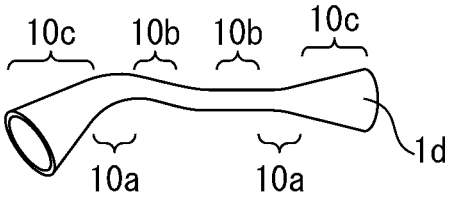

The first curved U-section intermediate part 1*c* obtained by the U-process has a bent part with a bottom part 3 curved in the longitudinal direction and is formed into an approximately U-section in the cross-section in the circumferential direction (section vertical to longitudinal direction). As the direction in which the bottom part 3 of the first curved U-section intermediate part 1*c* curves in the longitudinal direction, the direction projecting to the inside in the first curved U-section intermediate part 1*c*, that is, curvature upward in the figure as shown in FIG. 2E, is preferable, but as shown in FIG. 2E', the part may be curved in a direction projecting to the outside of the first curved U-section intermediate part 1*c*. The "inside of the first curved U-section intermediate part 1*c*" is the side at which the bottom part 12*a* of the punch 12 of the first die set 100 abuts against the bottom part 3 while the "outside of the first curved U-section intermediate part 1*c*" is the side at which the bottom part 11*a* of the die 11 of the first die set 100 abuts against the bottom part 3. The end parts along the longitudinal direction of the bent part of the first curved U-section intermediate part 1*c* may be formed in straight shapes or may be formed curved such as shown in FIG. 16F, for example, so as to project to the outside.

The die set used in the U-process may be the first die set 100 used in the first bending process. The bottom part 11*a* of the concaved part of the die 11, the top surface 11*b* of the die 11, and the bottom part 12*a* of the punch 12 are preferably formed with equal radii of curvature in the longitudinal direction. Further, the support part 11*d* of the die 11 may, for example, be arranged over the entire length of the die 11 in the longitudinal direction. It may also be arranged at part of the die 11 in the longitudinal direction. It is suitably selected in accordance with the obtained first curved U-section intermediate part.

The magnitude of the load supporting the support part 11*d* of the die 11 from below is suitably adjusted in accordance with the shape, material, and sheet thickness of the obtained first curved U-section intermediate part and, for example, may be changed during shaping.

Figure 10A:
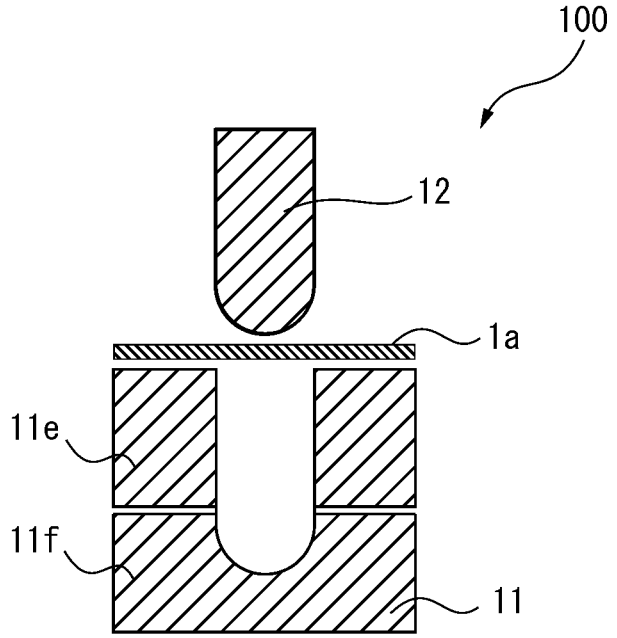
FIGS. 10A and 10B are cross-sectional views showing another example of a die set used for a U-process in a method for manufacturing a shaped part of the present invention.
Figure 10B:
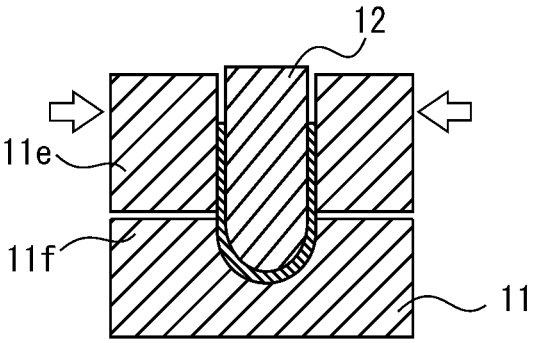

In the U-process, shaping may be performed while imparting a compressive force in the sheet thickness direction to the vertical wall parts of the approximately U-section. As the method for imparting a compressive force in the sheet thickness direction to the vertical wall parts of the approximately U-section, for example, it is possible to use the method of making the vertical wall parts 11*e* of the die 11 of the first die set 100 have structures able to move to the left and right with respect to the bottom part 11*f* of the die 11, as shown in FIG. 10A and of pressing the vertical wall parts 11*e* of the die 11 to the punch 12 side as shown by the white arrows in FIG. 10B. As the pressing method, hydraulic cylinders, springs, gas cushions, etc. can be used. The magnitude of the pressing is suitably adjusted in accordance with the shape, material, and sheet thickness of the obtained first curved U-section intermediate part, for example, may change during shaping.

O-Process

Figure 3F:
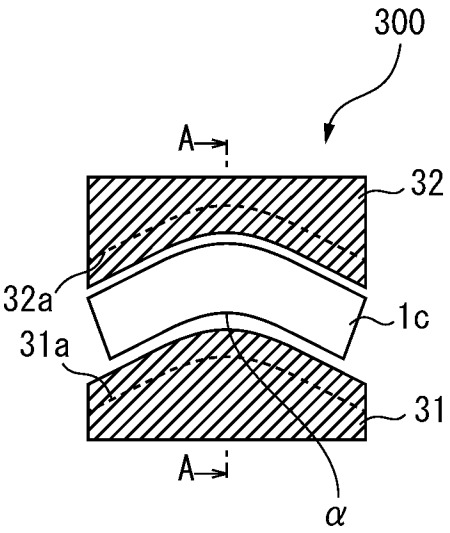
FIGS. 3F to 3H are process diagrams showing one example of an O-process in a method for manufacturing a shaped part of the present invention.
Figure 3G:
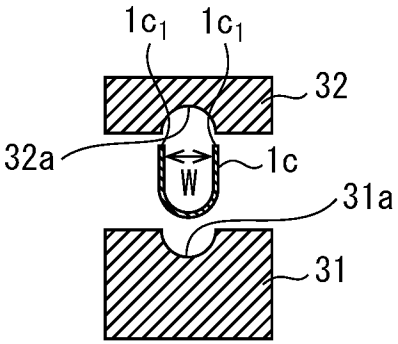
Figure 3H:
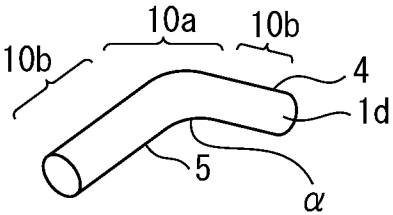

In the O-process, as shown in FIGS. 3F to 3H, the first curved U-section intermediate part 1*c* is press-formed so as to form a closed cross-section to obtain a tubular shaped part 1*d*.

As the method for shaping the first curved U-section intermediate part 1*c* so as to form a closed cross-section, press-forming is used. When shaping the first curved U-section intermediate part 1*c* so as to form a closed cross-section, a mandrel may be used as needed. By using a mandrel, it is possible to stably shape the tubular shaped part 1*d* even if the cross-sectional shape in the circumferential direction of the first curved U-section intermediate part 1*c* is a complicated shape.

FIGS. 3F to 3H are process diagrams showing one example of the O-process in the method for manufacturing a shaped part of the first embodiment. FIG. 3F is a front view, FIG. 3G is a side view of FIG. 3F, and FIG. 3H is a perspective view of a tubular shaped part 1*d* obtained by the O-process.

In the O-process, as shown in FIGS. 3F and 3G, a third die set 300 is prepared. The third die set 300 has a die 31 and a punch 32. The bottom part 31*a* of the concaved part of the die 31 and the bottom part 32*a* of the concaved part of the punch 32 are formed curved in the longitudinal direction. The concaved part of the die 31 and the concaved part of the punch 32 both have approximately semicircular type cross-sectional shapes.

Between the die 31 and punch 32 of the third die set 300, the first curved U-section intermediate part 1*c* is placed and press-formed so as to form a closed cross-section. The two edge parts $1c_1$ in the sheet width direction of the first curved U-section intermediate part 1*c* are made to abut against each other. The tubular shaped part 1*d* such as shown in FIG. 3H is obtained. The tubular shaped part 1*d* is shaped with the abutting part 4 and the bottom part 5 positioned at the opposite side from the abutting part 4 curved in the axial direction. The tubular shaped part 1*d* has a bent part 10*a* with a bottom part 5 curved in the axial direction and a straight part 10*b* with bottom part 5 extending in straight shape in the axial direction and having length in the circumferential direction equal along the center axis.

When like in the past simultaneously shaping the sheet into a U-section and bending it in the longitudinal direction, the metal sheet is bent in the sheet width direction and is bent in the longitudinal direction as well, so the compressive force is generated at the bottom surface in a state substantially close to flat and wrinkles easily occur. Further, when shaping the sheet into a U-section, then bending it in the longitudinal direction as well, depending on the shape or material of the shaped part, excessive deformation occurs in the bottom part and shaping defects easily occur.

As opposed to this, in the first embodiment, by bending the metal sheet 1*a* in the longitudinal direction, then shaping it into the first curved U-section intermediate part 1*c* with the U-section shape, it becomes possible to reduce the deformation of the longitudinal direction occurring at the bottom part 3 of the first curved U-section intermediate part 1*c*. Due to this, it is possible to keep down the occurrence of shaping defects of the bottom part 3. Therefore, it is possible to obtain a tubular shaped part 1*d* with no shaping defects.

In the O-process, the first curved U-section intermediate part 1*c* is press-formed so as to form a closed cross-section. A "closed cross-section" is a closed cross-section in a cross-section in the circumferential direction. It is a concept including not only a completely closed cross-section, but also a case where there is a clearance between the abutting edge parts. That is, at the abutting part 4 of the tubular shaped part 1*d*, the edge parts $1c_1$ may closely contact each other or may be separated from each other. If the abutting edge parts $1c_1$ have a clearance between them, preferably the length of the clearance in the sheet width direction is over 0 mm to 10 mm.

The tubular shaped part 1*d* obtained by the O-process is one having a bent part with a bottom part 5 positioned at the opposite side from the abutting part 4 curved in the longitudinal direction. In the cross-section in the circumferential direction, a closed cross-section is formed. The direction where the bottom part 5 of the tubular shaped part 1*d* is curved in the longitudinal direction is preferably a direction projecting to the inside of the tubular shaped part 1*d*, but it may also be a direction projecting to the outside of the tubular shaped part 1*d*. The abutting part 4 may be formed in a straight shape or may be formed curved so as, for example, to project to the outside. The "inside of the tubular shaped part 1*d*" is the side where the bottom part 32*a* of the punch 32 of the third die set 300 abuts against the bottom part 5, while the "outside of the tubular shaped part 1*d*" is the side where the bottom part 31*a* of the die 31 of the third die set 300 abuts against the bottom part 5.

The cross-sectional shape in the circumferential direction of the tubular shaped part 1*d* is not particularly limited and may be made a circular shape, elliptical shape, square shape, vertically asymmetric shape, and various other shapes.

Other Processes

In the first embodiment, after the O-process, a welding process may be performed for welding the abutting part 4 of the tubular shaped part 1*d*. Examples of the welding method may include arc welding, laser welding, and etc.

Further, in the first embodiment, before the first bending process, the ends of the metal sheet 1*a* may be bent, so-called C-forming, or other processing may be performed.

Shaped Part

Figure 9A:
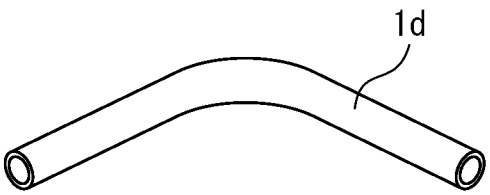
FIGS. 9A and 9B are schematic perspective views showing one example of a tubular shaped part of the present invention.
Figure 9B:
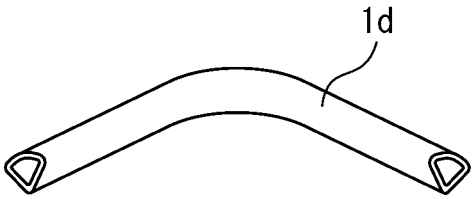

The shaped part manufactured by the first embodiment is a tubular shaped part 1*d*. The shape of the tubular shaped part 1*d* is not particularly limited so long as able to be shaped well by the method of the first embodiment. For example, a curved tube such as shown in FIG. 9A with a cross-sectional shape in the circumferential direction of a circular shape, a curved tube such as shown in FIG. 9B with a cross-sectional shape in the circumferential direction of a vertically asymmetric shape, a not shown different diameter tube, different cross-section tube, etc. can be illustrated. Further, the tubular shaped part 1*d* manufactured by the first embodiment may, for example, be a curved tube, a different diameter tube, different cross-section tube, etc. such as shown in FIGS. 16A to 16F.

2. Second Embodiment

The second embodiment is a preferred embodiment of the method for manufacturing a shaped part of the present invention. The second embodiment comprises a first bending process of press-forming a metal sheet to obtain a curved intermediate part curved in a longitudinal direction by a curvature α, a U-process of press-forming the curved intermediate part into an approximately U-section to obtain a first curved U-section intermediate part provided with a bottom part having the curvature α, a second bending process of press-forming for bending in a direction the same as the direction in which the bottom part of the first curved U-section intermediate part bends to obtain a second curved U-section intermediate part provided with a bottom part curved in the longitudinal direction by a curvature β, and an O-process of press-forming the second curved U-section intermediate part to form a closed cross-section to obtain a tubular shaped part provided with a bottom part having the curvature β.

That is, the second embodiment is characterized by including, between the U-process and the O-process, a second bending process of bending the first curved U-section intermediate part provided with a bottom part having a curvature α obtained by the U-process by press-forming in the same direction as the direction in which the bottom part of the first curved U-section intermediate part bends in the longitudinal direction to obtain a second curved U-section intermediate part provided with a bottom part having a curvature β curved in the longitudinal direction and press-forming the second curved U-section intermediate part in the O-process so as to form a closed cross-section to obtain a tubular shaped part provided with a bottom part having the curvature β.

According to the method for manufacture of the second embodiment, by bending the metal sheet in the longitudinal direction before shaping it into a U-section, it is possible to suppress the occurrence of shaping defects at the bottom part of the U-section. Therefore, it is possible to obtain a tubular shaped part with no shaping defects.

Further, in the second embodiment, by performing the bending in the longitudinal direction divided into the first bending process and the second bending process, it is possible to suitably adjust the deformation in the longitudinal direction occurring at the bottom part of the U-section and the end parts along the longitudinal direction of the bent part. Therefore, it is possible to more effectively suppress occurrence of shaping defects.

In this way, in the second embodiment, it is possible to further enlarge the shapeable range. For this reason, for example, it is possible to suppress occurrence of wrinkles or cracks and stably shape even a tubular shaped part having a bent part with a small radius of curvature or a tubular shaped part having a taper part.

First Bending Process

In the first bending process in the method for manufacturing a shaped part of the second embodiment, the metal sheet is shaped to obtain a curved intermediate part curved in the longitudinal direction by a curvature α. As the shaping method, press-forming is preferable, but the method is not particularly limited so long as a method able to shape a metal sheet curved in the longitudinal direction.

Figure 4A:
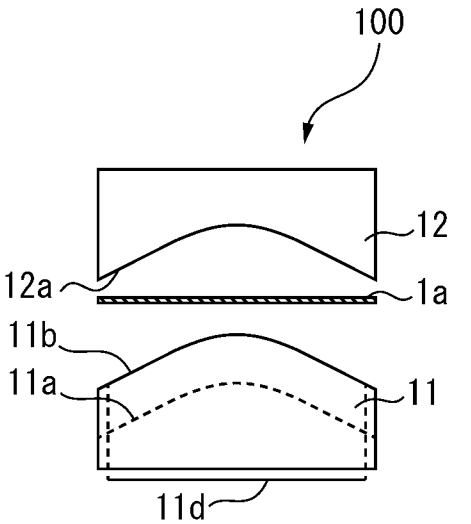
FIGS. 4A to 4F are process diagrams showing one example of a first bending process in a method for manufacturing a shaped part of the present invention.
Figure 4B:
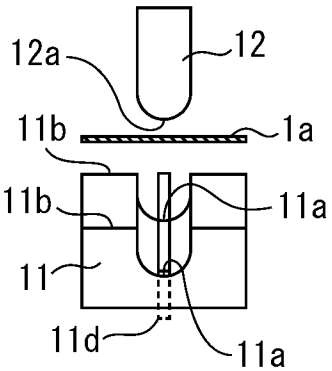
Figure 4C:
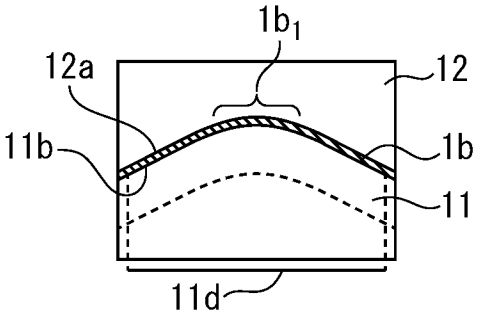
Figure 4D:
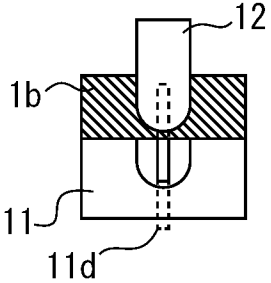
Figure 4E:
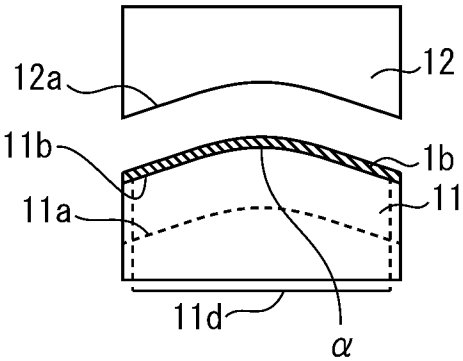
Figure 4F:
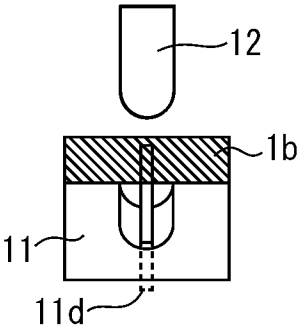

FIGS. 4A to 4F are process diagrams showing one example of a first bending process. FIGS. 4A, 4C, and 4E are front views, FIG. 4B is a side view of FIG. 4A, FIG. 4D is a side view of FIG. 4C, and FIG. 4F is a side view of FIG. 4E.

In the first bending process, as shown in FIGS. 4A and 4B, a first die set 100 is prepared. The first die set 100 has a die 11 and punch 12. The bottom part 11*a* of the concaved part of the die 11, the top surface 11*b* of the die 11, and the bottom part 12*a* of the punch 12 are all formed curved in the longitudinal direction.

The die 11 preferably has a support part 11*d* arranged at the bottom part of the die 11 and able to move in the vertical direction. The support part 11*d* is supported by a not shown load source from below. The load source is not particularly limited, but a hydraulic cylinder, spring, gas cushion, etc. can be used.

A metal sheet 1*a* can be placed between the die 11 and punch 12 of the first die set 100 and, as shown in FIGS. 4C and 4D, clamped by the top surface 11*b* of the die 11 and the bottom part 12*a* of the punch 12 of the first die set so as to make the metal sheet 1*a* curve to have a curvature α. Due to this, a curved intermediate part 1*b* having the curvature α curved in the longitudinal direction such as shown in FIGS. 4E and 4F is obtained.

Preferably, the metal sheet 1*a* is clamped by the top surface 11*b* of the die 11 and the bottom part 12*a* of the punch 12 of the first die set and supported by the support part 11*d* while making the metal sheet 1*a* curve. Due to this, it is possible to control the curvature α better. When making the metal sheet 1*a* curve, the support part 11*d* may move according to the load by which the metal sheet 1*a* is pushed to the bottom part 12*a* side of the punch 12 to an extent where the metal sheet 1*a* does not plastically deform into an approximately U-section.

The curvature α of the bottom part of the first curved U-section intermediate part 1*c* is preferably 50% to 80% of the curvature β of the bottom part of the second curved U-section intermediate part obtained by the later explained second bending process. That is, the ratio α/β of the curvature α of the first curved U-section intermediate part with respect to the curvature β of the second curved U-section intermediate part is 0.5 to 0.8. Due to the curvature α being within the preferred range, it is possible to more suitably adjust the deformation in the longitudinal direction occurring at the bottom part of the U-section and the end parts along the longitudinal direction of the bent part and possible to more effectively suppress the occurrence of shaping defects.

The rest of the configuration of the metal sheet and curved intermediate part 1*b* is similar to the first bending process of the above first embodiment, so here the explanations will be omitted.

U-Process

Figure 5G:
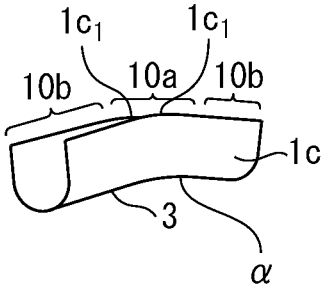
FIG. 5G is a process diagram showing one example of a U-process in a method for manufacturing a shaped part of the present invention.

In the U-process, as shown in FIG. 5G, the curved intermediate part 1*b* having the curvature α obtained at the first bending process is shaped into an approximately U-section to obtain a first curved U-section intermediate part 1*c* provided with a bottom part having the curvature α curved in the longitudinal direction.

In the U-process, press-forming is used. The U-process is not particularly limited so long as using a die set giving the first curved U-section intermediate part 1*c*, but it is possible to use the first die set 100 used in the first bending process. The curved intermediate part 1*b* is placed between the die 11 and punch 12 of the first die set 100, then the concaved part of the die 11 and the punch 12 is used to press-form the curved intermediate part 1*b* into an approximately U-section to obtain the first curved U-section intermediate part 1*c* provided with a bottom part 3 having a curvature α such as shown in FIG. 5G. The curvature α of the metal sheet 1*a* formed at the first bending process is substantially maintained at the bottom part 3 of the first curved U-section intermediate part 1*c* obtained by the U-process. FIG. 5G is a perspective view of the first curved U-section intermediate part 1*c* obtained by the U-process.

When press-forming the curved intermediate part 1*b* into an approximately U-section by the U-process, the curved intermediate part 1*b* is preferably in a state clamped between the bottom part 12*a* of the punch 12 and the support part 11*d* of the die 11. The curved intermediate part 1*b* is press-formed to an approximately U-section in the state where the curved intermediate part 1*b* is clamped between the bottom part 12*a* of the punch 12 and the support part 11*d* of the die 11 to thereby better control the curvature of the bottom part 3 of the obtained first curved U-section intermediate part 1*c*.

The first curved U-section intermediate part 1*c* is formed with the bottom part 3 curved in the longitudinal direction. The first curved U-section intermediate part 1*c* has a bent part 10*a* with the bottom part 3 curved in the longitudinal direction and a straight part 10*b* with bottom part 3 extending in straight shape in the longitudinal direction and with length of the approximately U-cross-section equal along the center line.

The rest of the configuration of the first die set and the first curved U-section intermediate part is similar to the U-process of the above first embodiment, so here the explanations will be omitted.

Second Bending Process

In the second bending process, the first curved U-section intermediate part 1*c* is bent in the longitudinal direction. The direction of bending in the second bending process is the same direction as the direction in which the bottom part 3 of the first curved U-section intermediate part 1*c* is bent in the longitudinal direction. Due to this, a second curved U-section intermediate part 1*e* provided with a bottom part 6 having curvature β curved in the longitudinal direction is obtained.

As the working method, press-forming is preferred, but the method is not particularly limited so long as a method able to bend the first curved U-section intermediate part in the longitudinal direction.

Figure 6J:
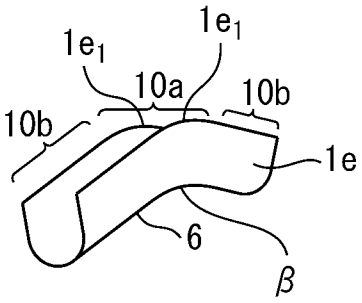
FIGS. 6H to 6J are process diagrams showing one example of a second bending process in a method for manufacturing a shaped part of the present invention.
Figure 6I:
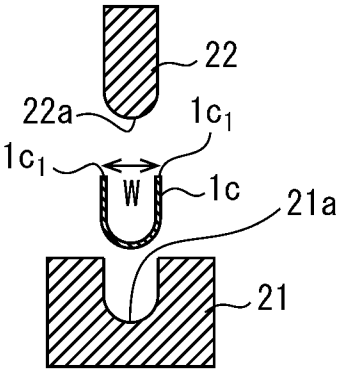
Figure 6H:
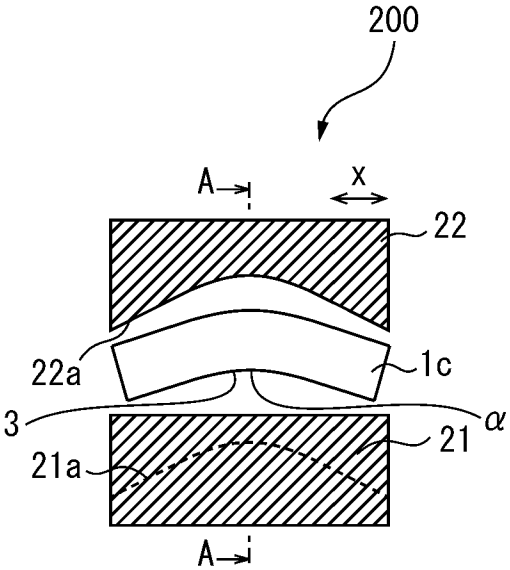

FIGS. 6H to 6J are process diagrams showing one example of the second bending process. FIG. 6H is a front view, FIG. 6I is a side view of FIG. 6H, and FIG. 6J is a perspective view of a second curved U-section intermediate part 1*e* obtained at the second bending process.

In the second bending process, as shown in FIGS. 6H and 6I, a second die set 200 is prepared. The second die set 200 has a die 21 and punch 22. The bottom part 21*a* of the concaved part of the die 21 and the bottom part 22*a* of the punch 22 are formed curved in the longitudinal direction.

A first curved U-section intermediate part 1*c* provided with a bottom part 3 having a curvature α curved in the longitudinal direction is placed between the die 21 and punch 22 of the second die set 200. The first curved U-section intermediate part 1*c* is bent in the longitudinal direction to obtain a second curved U-section intermediate part 1*e* provided with a bottom part 6 having a curvature β in the longitudinal direction such as shown in FIG. 6J. The direction of bending in the second bending process is the same direction as the direction in which the bottom part 3 of the first curved U-section intermediate part 1*c* is bent in the longitudinal direction. The curvature β of the second curved U-section intermediate part 1*e* is larger than the curvature α and is substantially maintained at the bottom part 5 of the tubular shaped part 1*d* obtained by the O-process. The curvature β is calculated as a reciprocal of a radius of curvature calculated from a curve shown by the surface of the inner side in the longitudinal direction of the bottom part 6 of the bent part 10*a* as shown in FIG. 6J.

The second curved U-section intermediate part 1*e* is formed with the bottom part 6 curved in the longitudinal direction. The second curved U-section intermediate part 1*e* has a bent part 10*a* with the bottom part 6 curved in the longitudinal direction and straight part 10*b* with bottom part 6 extending in straight shape in the longitudinal direction and with length of the approximately U-cross-section equal along the center line.

The radius of curvature in the longitudinal direction at the surface of the inner side of the bent part 10*a* of the second curved U-section intermediate part 1*e* differs according to the material, the shape of the shaped part, etc., but can preferably be set in the range of 1.5 to 10 times the width of the U-section. If the lower limit of the radius of curvature is in the preferable range, it is possible to better keep wrinkles and cracks from occurring at the bent part in the second bending process. If the upper limit of the radius of curvature is in the above range, it is possible to more stably obtain the effect of bending in the longitudinal direction with respect to the first curved U-section intermediate part in the second bending process. Here, the "width of the U-section" indicates the width W over which the inside surfaces of the first curved U-section intermediate part 1*c* face each other such as shown in for example FIG. 6I.

The second curved U-section intermediate part 1*e* obtained at the second bending process has a bent part with a bottom part 6 curved in the longitudinal direction and is formed into an approximately U-section in the cross-section in the circumferential direction (cross-section vertical to longitudinal direction). As the direction in which the bottom part curves in the longitudinal direction, a direction projecting to the inside of the second curved U-section intermediate part 1*e*, that is, curving upward in the figure as shown in FIG. 6J, is preferable, but a direction projecting to the outside of the second curved U-section intermediate part 1 is also possible. The "inside of the second curved U-section intermediate part 1*e*" is the side at which the bottom part 22*a* of the punch 22 of the second die set 200 abuts against the bottom part 6 while the "outside of the second curved U-section intermediate part 1*e*" is the side at which the bottom part 21*a* of the die 21 of the second die set 200 abuts against the bottom part 6. The end parts along the longitudinal direction of the bent part of the second curved U-section intermediate part 1*e* may be formed in straight shapes or may be formed curved so as to project to the outside.

In the second bending process, shaping may be performed while imparting a compressive force in the sheet thickness direction to the vertical wall parts of the approximately U-section. As the method for imparting a compressive force in the sheet thickness direction to the vertical wall parts of the approximately U-section, for example, it is possible to use the method of making the vertical wall parts 21*e* of the die 21 of the second die set 200 have structures able to move to the left and right with respect to the bottom part 21*f* of the die 21, as shown in FIG. 10A and of pressing the vertical wall parts 21*e* of the die 21 to the punch 22 side as shown by the white arrows in FIG. 10B. As the pressing method, hydraulic cylinders, springs, gas cushions, etc. can be used. The magnitude of the pressing is suitably adjusted in accordance with the shape, material, and sheet thickness of the obtained second curved U-section intermediate part, for example, may be changed during shaping.

O-Process

In the O-process, the second curved U-section intermediate part 1*e* is press-formed so as to form a closed cross-section to obtain a tubular shaped part 1*d*.

As the method for shaping so as to form a closed cross-section, press-forming is used. When shaping the sheet to form a closed cross-section, a mandrel may be used as needed. By using a mandrel, it is possible to stably shape the sheet even if the cross-sectional shape in the circumferential direction is a complicated shape.

Figure 7K:
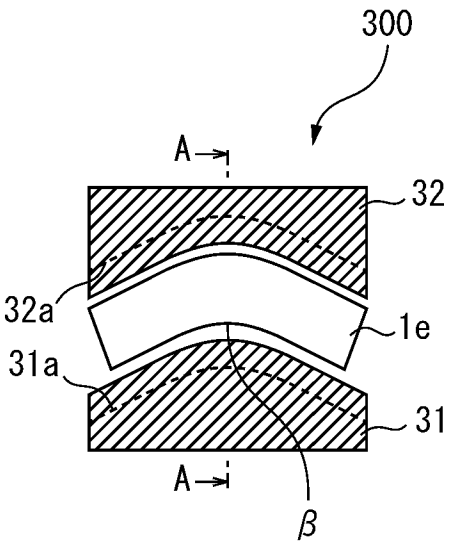
FIGS. 7K to 7M are process diagrams showing one example of an O-process in a method for manufacturing a shaped part of the present invention.
Figure 7L:
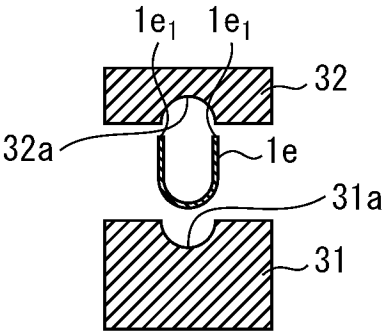
Figure 7M:
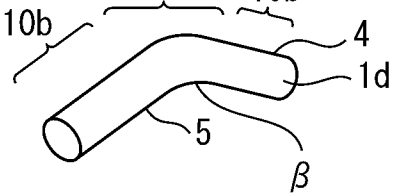

FIGS. 7K to 7M are process diagrams showing one example of the O-process in the method for manufacturing a shaped part of the second embodiment. FIG. 7K is a front view, FIG. 7L is a side view of FIG. 7K, and FIG. 7M is a perspective view of the tubular shaped part 1*d* obtained by the O-process.

In the O-process, as shown in FIGS. 7K and 7L, a third die set 300 is prepared. The third die set 300 has a die 31 and punch 32. The bottom part 31*a* of the concaved part of the die 31 and the bottom part 32*a* of the concaved part of the punch 32 are formed curved in the longitudinal direction. The concaved part of the die 31 and the concaved part of the punch 32 both have approximately semicircular cross-sectional shapes.

The second curved U-section intermediate part 1*e* is placed between the die 31 and punch 32 in the third die set 300 and shaped whereupon a tubular shaped part 1*d* such as shown in FIG. 7M is obtained. The tubular shaped part 1*d* is formed with the abutting part 4 and the bottom part 5 positioned at the opposite side from the abutting part 4 curved in the axial direction. The tubular shaped part 1*d* has a bent part 10*a* with a bottom part 5 curved in the axial direction and a straight part 10*b* with bottom part 5 extending in straight shape in the axial direction and with equal length in the circumferential direction along the center axis.

In the O-process, the second curved U-section intermediate part 1*e* is press-formed so as to form a closed cross-section. A "closed cross-section" is a closed cross-section in a cross-section in the circumferential direction. It is a concept including not only a completely closed cross-section, but also a case where there is a clearance between the abutting edge parts. That is, at the abutting parts 4 of the tubular shaped part 1*d*, the edge parts $\mathbf{1}e_1$ may closely contact each other or may be separated from each other. If the abutting edge parts $\mathbf{1}e_1$ have clearance between them, preferably the length of the clearance in the sheet width direction is over 0 mm to 10 mm.

The rest of the configuration of the tubular shaped part obtained by the O-process is similar to the O-process of the above first embodiment, so here the explanations will be omitted.

Other Processes

In the second embodiment, after the O-process, it is also possible to perform a welding process for welding the abutting part 4 of the tubular shaped part 1*d*. Examples of the welding method may include arc welding, laser welding, and etc.

Further, in the second embodiment, before the first bending process, the ends of the metal sheet may be bent, so-called C-forming, or other processing may be performed.

Shaped Part

A shaped part manufactured by the second embodiment is a tubular shaped part. For example, it may be a curved tube, different diameter tube, different cross-section tube, etc. As the shape of the tubular shaped part, for example, a curved tube such as shown in FIGS. 16A and 16B having a cross-sectional shape in the circumferential direction of a circular shape and having a bent part 10*a* and straight parts 10*b*, a horn shaped different diameter tube such as shown in FIG. 16C having a cross-sectional shape in the circumferential direction of a circular shape and having a bent part 10*a*, a straight part 10*b*, and a taper part 10*c*, a horn shaped different diameter tube such as shown in FIG. 16D having a cross-sectional shape in the circumferential direction changing from a circular shape to a square shape and having a bent part 10*a*, a straight part 10*b*, and a taper part 10*c*, a curved tube such as shown in FIG. 16E having a cross-sectional shape in the circumferential direction of a vertically asymmetric shape and having a bent part 10*a* and straight parts 10*b*, a different diameter tube such as shown in FIG. 16F having pluralities of bent parts 10*a*, straight parts 10*b*, and taper parts 10*c*, etc. may be illustrated.

Modification of Second Embodiment

A modification of the second embodiment will be explained below.

First Bending Process

Figure 11A:
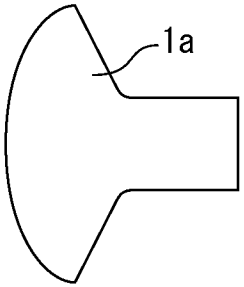
FIGS. 11A to 11D are process diagrams showing another example of a first bending process in a method for manufacturing a shaped part of the present invention.
Figure 11B:
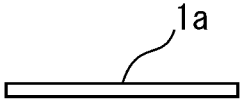
Figure 11C:
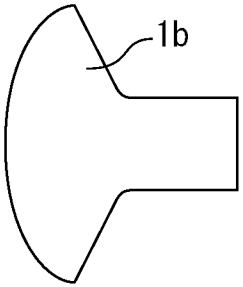
Figure 11D:
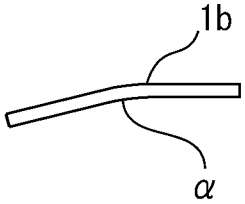

FIGS. 11A to 11D are process diagrams showing an example of the first bending process of the present modification. FIGS. 11B and 11D are front views, FIG. 11A is a top view of FIG. 11B, and FIG. 11C is a top view of FIG. 11D.

In the first bending process, a metal sheet 1*a* such as shown in FIGS. 11A and 11B is prepared.

Next, as shown in FIGS. 11C and 11D, a curved intermediate part 1*b* curved in the longitudinal direction by a curvature $\alpha$ is press-formed.

U-Process

Figure 12E:
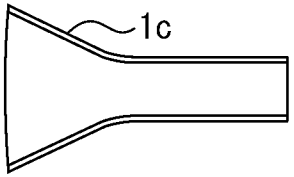
FIGS. 12E to 12H are process diagrams showing another example of a U-process in a method for manufacturing a shaped part of the present invention.
Figure 12F:
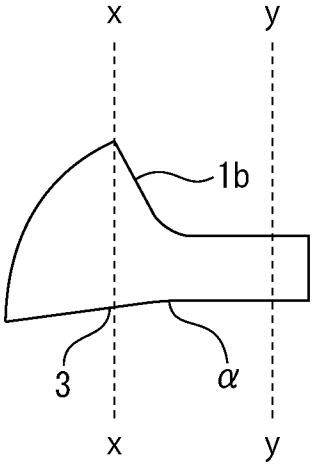
Figure 12G:
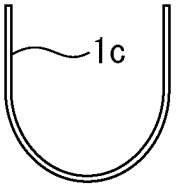
Figure 12H:
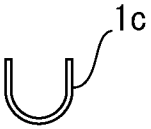

FIGS. 12E to 12H are process diagrams showing an example of the U-process of the present modification. FIG. 12F is a front view, FIG. 12E is a top view of FIG. 12F, FIG. 12G is a cross-sectional view at the broken line part x-x of FIG. 12F, and FIG. 12H is a cross-sectional view at the broken line part y-y of FIG. 12F.

In the U-process, the curved intermediate part 1*b* is press-formed into an approximately U-section whereby as shown in FIGS. 12E, 12F, 12G, and 12H, a first curved U-section intermediate part 1*c* with a bottom part 3 formed curved in the longitudinal direction by a curvature $\alpha$ and with an approximately U-section in the cross-section in the circumferential direction is obtained.

Second Bending Process

Figure 13I:
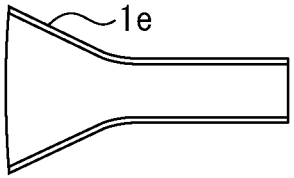
FIGS. 13I to 13L are process diagrams showing another example of a second bending process in a method for manufacturing a shaped part of the present invention.
Figure 13J:
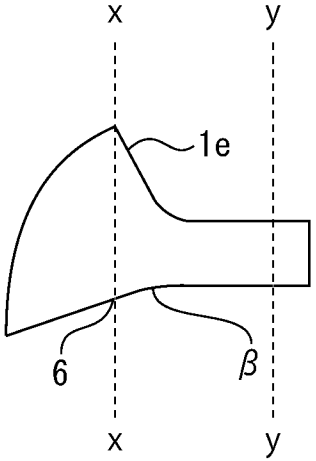
Figure 13K:
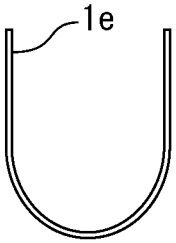
Figure 13L:
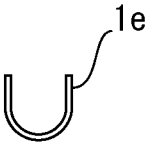

FIGS. 13I to 13L are process diagrams showing an example of the second bending process of the present modification. FIG. 13J is a front view, FIG. 13I is a top view of FIG. 13J, FIG. 13K is a cross-sectional view and left side view at the broken line part x-x of FIG. 13J, and FIG. 13L is a cross-sectional view at the broken line part y-y of FIG. 13J.

In the second bending process, the curved U-section intermediate part 1*c* is bent in the longitudinal direction. The direction of bending in the second bending process is the same direction as the direction by which the bottom part 3 of the first curved U-section intermediate part 1*c* is bent in the longitudinal direction. Due to this, as shown in FIGS. 13I, 13J, 13K, and 13L, a second curved U-section intermediate part 1*e* with a bottom part 6 formed curved by a curvature β in the longitudinal direction and with an approximately U-section in the cross-section in the circumferential direction is obtained.

O-Process

Figure 14M:
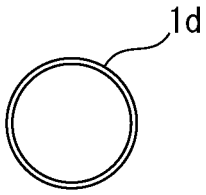
FIGS. 14M to 14O are process diagrams showing another example of an O-process in a method for manufacturing a shaped part of the present invention.
Figure 14N:
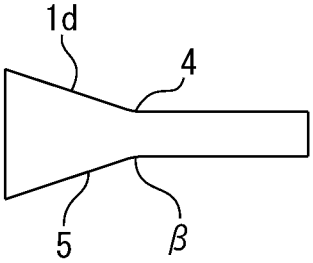
Figure 14O:
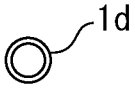
Figure 15A:
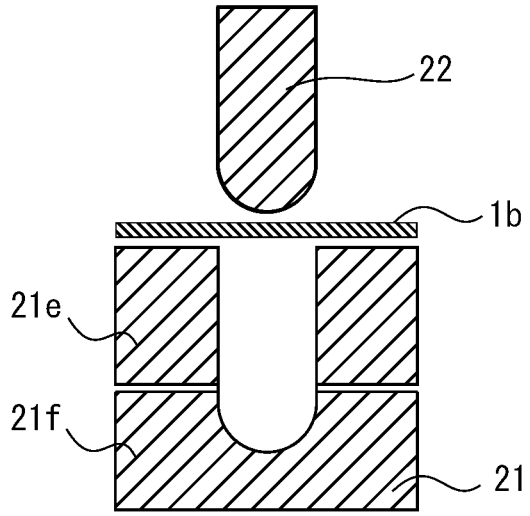
FIGS. 15A and 15B are cross-sectional views showing another example of a die set used for a second bending process in a method for manufacturing a shaped part of the present invention.
Figure 15B:
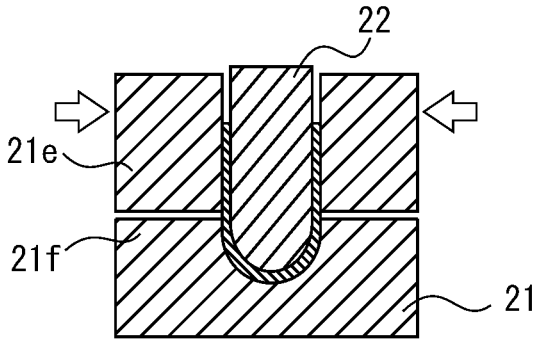

FIGS. 14M to 14O are process diagrams showing an example of the O-process of the present modification. FIG. 14N is a left side view of FIG. 14M, while FIG. 14O is a right side view of FIG. 14M.

In the O-process, a tubular shaped part 1*d* is formed. The abutting part 4 and the bottom part 5 positioned at the opposite side of the abutting part 4 are formed curved by the curvature β in the axial direction.

In the modification of the second embodiment as well, by bending the metal sheet in the longitudinal direction before shaping it to a U-section, it is possible to reduce the deformation in the longitudinal direction occurring at the bottom part of the U-section and thereby suppress the occurrence of shaping defects. Therefore, it is possible to obtain a tubular shaped part with no shaping defects.

Further, in the modification of the second embodiment as well, by performing the bending in the longitudinal direction divided into the first bending process and the second bending process, it is possible to suitably adjust the deformation in the longitudinal direction occurring at the bottom part of the U-section and the end parts along the longitudinal direction of the bent part. Therefore, it is possible to more effectively suppress occurrence of shaping defects.

In this way, in the modification of the second embodiment as well, the shapeable range can be further enlarged. For this reason, for example, a tubular shaped part having a bent part with a small radius of curvature and a tubular shaped part having a taper part can suppress occurrence of wrinkles and cracks and be stably shaped.

EXAMPLES

Below, examples will be given to specifically explain the present invention.

Fabrication of Tubular Shaped Part

Example 1

A bent round tube 1*d* such as shown in FIG. 16A having a curvature α was prepared. The curvature α in the longitudinal direction at the surface of the inner side of the bent part 10*a* of the bent round tube 1*d* was 0.000465 (1/mm) (radius of curvature of 215 mm), the bending angle of the bent part 10*a* was 40°, the outside diameter of the bent round tube was 65 mm, and the lengths of the straight parts 10*b* were 150 mm. The "bending angle" of the bent part means the smaller angle of the angles formed by the line of the extension of the axis of one straight part of the tubular shaped part (broken line of FIG. 16A) and the line of the extension of the axis of the other straight part (broken line of FIG. 16A).

For the metal sheet, a hot rolled steel sheet having a shape such as shown in FIG. 8 with a width at a center of bending wider than the widths at the two ends, having a TS: 390 MPa, and having a sheet thickness of 2.6 mm was used.

The die set such as shown in FIGS. 1A and 1B was used to successively perform the first bending process, U-process, and O-process shown in FIGS. 1A to 1D to FIGS. 3F to 3H.

The bent part could be formed without occurrence of cracks or wrinkles. Further, in the O-process, the abutting part was good in shape and could be joined by laser arc hybrid welding.

Comparative Example 1

Except for simultaneously shaping the U-section and bending in the longitudinal direction, a bent round tube similar to Example 1 was prepared.

At the obtained bent round tube, wrinkles occurred at the bottom part of the U-section and shaping was not possible.

Example 2

A bent round tube similar to Example 1 was prepared.

For the metal sheet, a hot rolled steel sheet having a shape such as shown in FIG. 8 with a width at a center of bending wider than the widths at the two ends, having a TS: 390 MPa, and having a sheet thickness of 2.6 mm was used.

The die set such as shown in FIGS. 4A and 4B was used to successively perform the first bending process, U-process, second bending process, and O-process shown in FIGS. 4A to 4F to FIGS. 7K to 7M.

The bent part could be formed without occurrence of cracks or wrinkles. Further, in the O-process, the abutting part was good in shape and could be joined by laser arc hybrid welding.

Example 3

A bent round tube 1*d* such as shown in FIG. 16B having a curvature β was prepared. The curvature β in the longitudinal direction at the surface of the inner side of the bent part 10*a* of the bent round tube 1*d* was 0.01 (1/mm) (radius of curvature of 100 mm), the bending angle of the bent part 10*a* was 40°, the outside diameter of the bent round tube was 65 mm, and the lengths of the straight parts 10*b* were 150 mm.

For the metal sheet, a hot rolled steel sheet having a shape such as shown in FIG. 8 with a width at a center of bending wider than the widths at the two ends, having a TS: 390 MPa, and having a sheet thickness of 2.6 mm was used.

The die set such as shown in FIGS. 4A and 4B was used to successively perform the first bending process, U-process, second bending process, and O-process shown in FIGS. 4A to 4F to FIGS. 7K to 7M.

The bent part could be formed without occurrence of cracks or wrinkles. Further, in the O-process, the abutting part was good in shape and could be joined by laser arc hybrid welding.

Comparative Example 2

Except for simultaneously shaping the U-section and bending in the longitudinal direction, a bent round tube similar to Example 3 was prepared.

At the obtained bent round tube, wrinkles occurred at the bottom part of the U-section and shaping was not possible.

Example 4

A horn shaped different diameter tube 1*d* such as shown in FIG. 16C was prepared. The curvature β in the longitudinal direction at the surface of the inner side of the bent part 10*a* of the different diameter tube 1*d* was 0.0025 (1/mm) (radius of curvature of 400 mm), the bending angle of the bent part 10*a* was 10°, the outside diameter of the straight part 10*b* was 40 mm, and the lengths of the straight parts 10*b* were 150 mm.

For the metal sheet, a cold rolled steel sheet having a TS: 270 MPa and a sheet thickness of 1.2 mm was used.

By the processes such as shown in FIGS. 11A to 11D to FIGS. 14M to 14O, the first bending process, U-process, second bending process, and O-process were successively performed.

The bent part could be formed without occurrence of cracks or wrinkles. Further, in the O-process, the abutting part was good in shape and could be joined by laser arc hybrid welding.

Comparative Example 3

Except for simultaneously shaping the U-section and bending in the longitudinal direction, a horn shaped different diameter tube similar to Example 4 was prepared.

At the obtained horn shaped different diameter tube, wrinkles occurred at the bottom part of the U-section and shaping was not possible.

Evaluation

The tubular shaped parts of Examples 1 to 4 and Comparative Examples 1 to 3 obtained in this way were respectively investigated for the occurrence of cracks and wrinkles in the middle of shaping. Further, the above tubular shaped parts were respectively investigated for weld defects at the time of the end of shaping. The results of these are also shown below.

In the examples where cracks and wrinkles occurred in the middle of shaping (specifically, Comparative Examples 1, 2, and 3), subsequent shaping became impossible, so the O-process was not performed. For this reason, in the examples where cracks and wrinkles occurred in the middle of shaping, whether "weld defects" would occur could not be judged.

TABLE

| | Cracks and wrinkles during shaping | Weld defects (after O-process) |
|---|---|---|
| Comparative Example 1 | Yes (wrinkles of bottom part) | — |
| Comparative Example 2 | Yes (wrinkles of bottom part) | — |
| Comparative Example 3 | Yes (wrinkles of bottom part) | — |
| Example 1 | None | None |
| Example 2 | None | None |
| Example 3 | None | None |
| Example 4 | None | None |

According to Table 1, it is learned that in each of Examples 1 to 4, which fall in the scope of the technical idea of the present invention, good results of "None" are obtained in all of the items of cracks and wrinkles during shaping and weld defects. As opposed to this, it is learned that in each of Comparative Examples 1 to 3, which are outside the scope of the technical idea of the present invention, undesirable results are obtained in at least one of the items.

Evaluation of Shapeable Range

Figure 18:
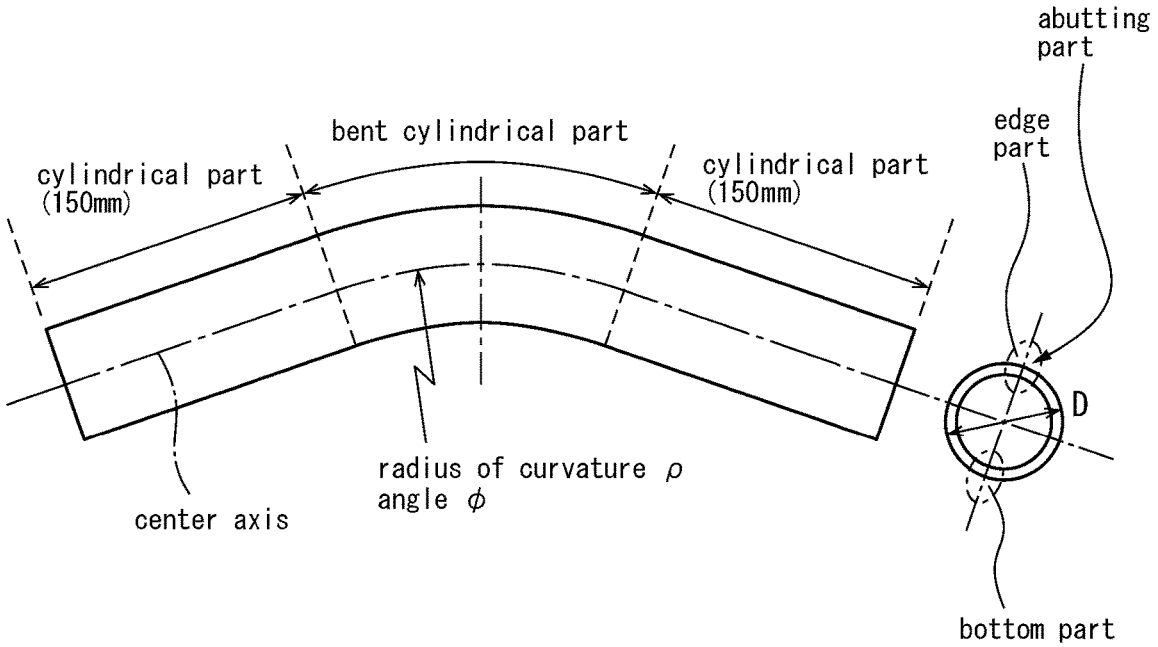
FIG. 18 is a front view of a curved cylindrical tube evaluated and a cross-sectional view in a direction vertical to an axial direction of the curved cylindrical tube at a right end part.
Figure 19:
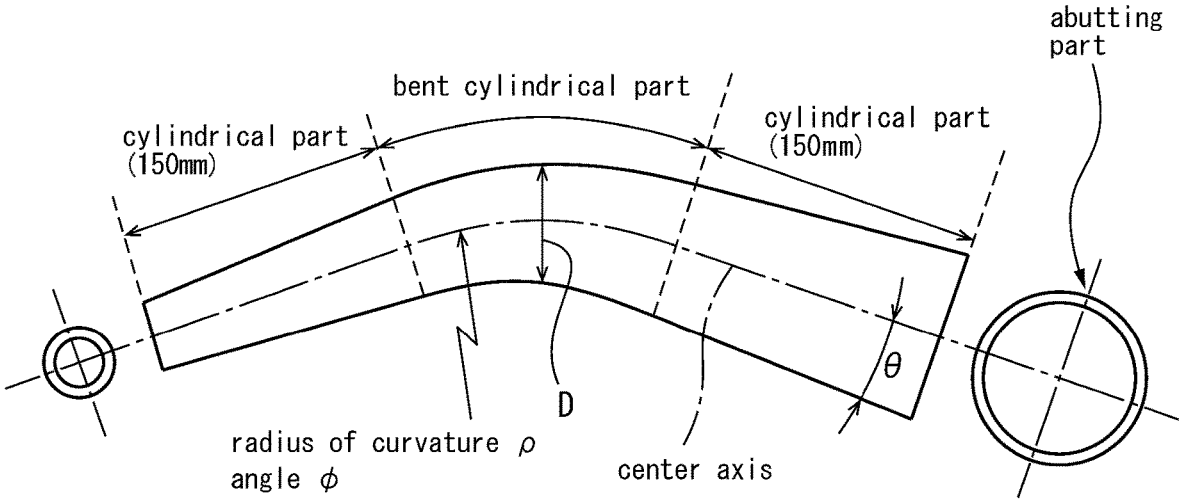
FIG. 19 is a front view of a curved conical tube evaluated and a cross-sectional view in a direction vertical to an axial direction of the curved conical tube at a right end part and a left end part.

The shapeable ranges of the curved cylindrical tube and curved conical tube resulting from the material and thickness of the metal sheets were evaluated. FIG. 18 is a front view of the evaluated curved cylindrical tube and a cross-sectional view in a direction vertical to the axial direction of the curved cylindrical tube at the right end part. FIG. 19 is a front view of the evaluated curved conical tube and a cross-sectional view at a right end part and left end part in a direction vertical to the axial direction of the curved conical tube.

The curved cylindrical tube was prescribed by the three parameters of the outside diameter D of the cylindrical part, the radius of curvature ρ with respect to the axis of the curved part, and the bending angle φ. The curved conical tube is prescribed by the four parameters of the three parameters of the curved cylindrical tube plus the opening angle θ of the conical part.

To evaluate the shapeable range, the finite element method (FEM) was used. For the FEM, a general use code PAM-STAMP of the dynamic explicit method was used. The tool was a rigid body. The blank was modeled using shell elements. The material properties were found by approximation of the stress-strain graph obtained by the tensile test by a Swift formula. Between the tool and sheet, the frictional coefficient was a Coulomb friction of 0.15. For a different diameter tube, the mesh was set by first dividing the tube in 75 parts in the longitudinal direction (about 4 mm) and 26 parts in the circumferential direction (about 4.6 mm). Elements of greatly deforming portions were automatically divided again (four equal parts) (refinement function). For a curved cylindrical tube and curved conical tube, the tube was divided into 88 parts in the longitudinal direction (about 5 mm) and 56 parts in the circumferential direction (about 4 mm). The integration points were five points in the sheet thickness direction.

Figure 20:
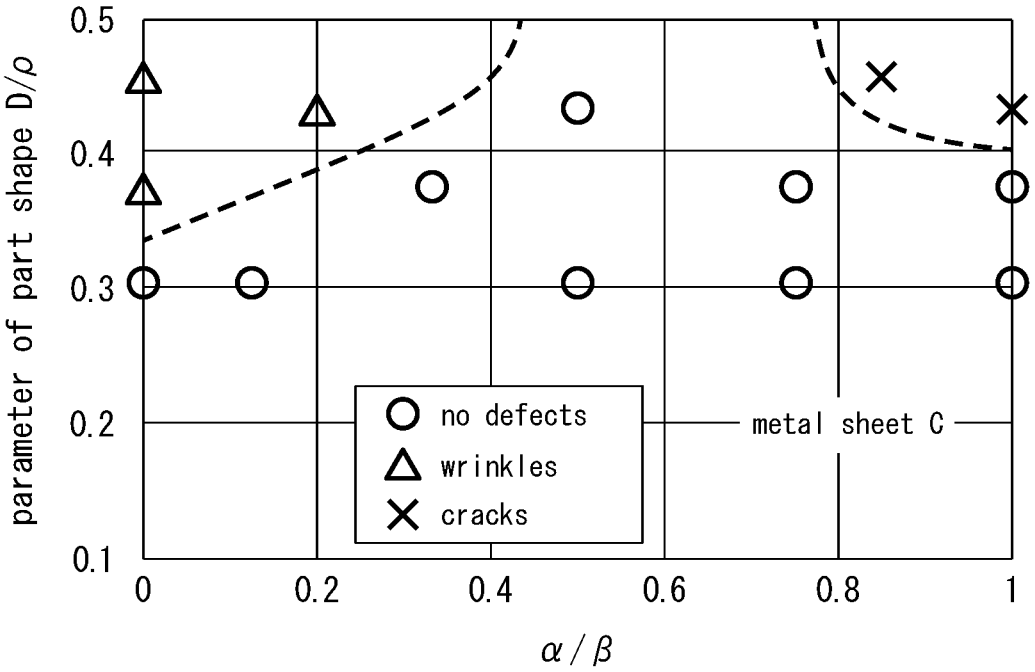
FIG. 20 is a graph showing a shapeable range of a curved cylindrical tube and curved conical tube in the case of a thickness of a metal sheet of 2.6 mm.
Figure 21:
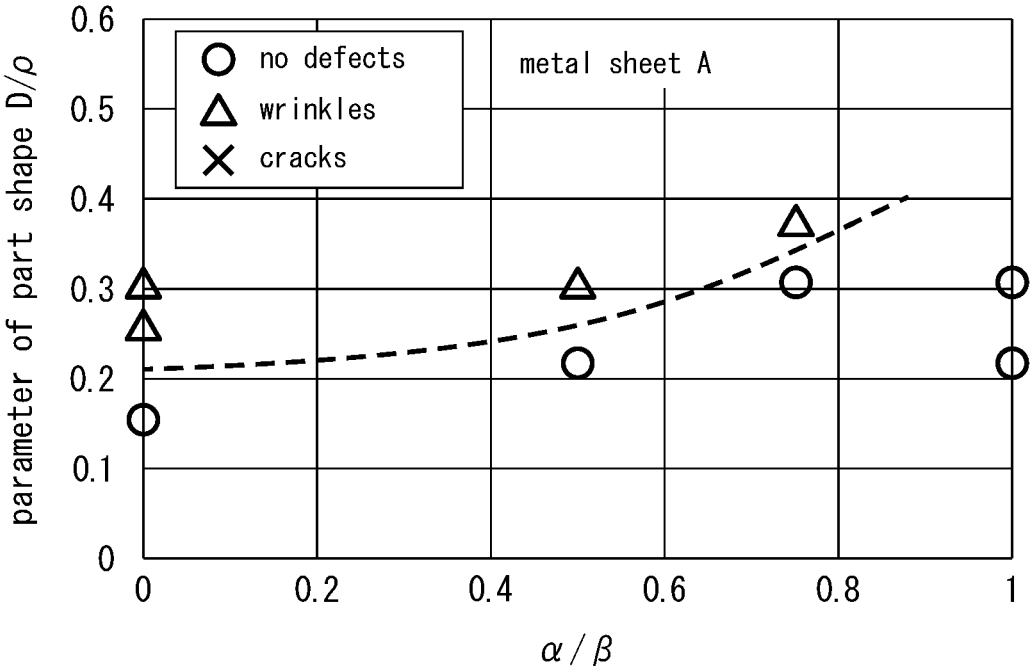
FIG. 21 is a graph showing a shapeable range of a curved cylindrical tube and curved conical tube in the case of a thickness of a metal sheet of 2.0 mm.

The shapeable range of a curved cylindrical tube and curved conical tube in the case of a thickness of the metal sheet of 2.6 mm is shown in FIG. 20. The shapeable range of a curved cylindrical tube and curved conical tube in the case of a thickness of the metal sheet of 2.0 mm is shown in FIG. 21. The geometric shape parameter of the curved cylindrical tube and curved conical tube strongly affecting the shapeability is the single outside diameter of the cylindrical part D/radius of curvature ρ, so this was taken along the vertical axis to evaluate the ratio of the curvature α/β. The material properties for evaluating the shapeable range in FIGS. 20 and 21 are shown in Table 2. The tensile test of the material was performed using a No. 5 test piece by JIS Z2241 "Method of Tensile Test of Metal Materials".

TABLE 2

| | Material | Tensile strength TS (MPa) | Elongation EL (%) | Thickness (mm) |
|---|---|---|---|---|
| FIG. 20 | Metal sheet C | 450 | 35 | 2.6 |
| FIG. 21 | Metal sheet A | 340 | 44 | 2.0 |

In FIG. 21, the metal sheet A is thin in thickness, so buckling easily occurred and in the shapeable range of the metal sheet A, the buckling limit moved to the small D/p side compared with the metal sheet C. Further, the metal sheet A was better in ductility than the metal sheet C, so the fracture limit moved to the large D/p side.

That is, from FIGS. 20 and 21, it is learned that in the metal sheet C with a large thickness of the metal sheet, the boundary between "Good" (no defects) and "Fair" (wrinkles) moves to the upward side in the figure and the buckling and wrinkle limit is improved. Further, it is learned that the better the ductility of the material, the more the boundary between "Good" (no defects) and "Poor" (cracks) moves to the upward side in the figure and the more the fracture limit is improved.

From FIGS. 20 and 21, it was learned that to shape a curved cylindrical tube and curved conical tube without causing wrinkles or cracks, $\alpha/\beta=0.5$ to 0.8 is preferable.

REFERENCE SIGNS LIST

100 first die set
200 second die set
300 third die set
1*a* metal sheet
1*b* curved intermediate part
1*b*$_1$ bent part of curved intermediate part
1*c* first curved U-section intermediate part
1*c*$_1$ edge part in direction vertical to longitudinal direction of first curved U-section intermediate part or tubular shaped part
1*e*$_1$ edge part in direction vertical to longitudinal direction of second curved U-section intermediate part or tubular shaped part
1*d* tubular shaped part
1*e* second curved U-section intermediate part
3, 5, 6 bottom part
4 abutting part
10*a* bent part
10*b* straight part
10*c* taper part
11, 21, 31 die
12, 22, 32 punch
11*a*, 21*a*, 31*a* bottom part of concaved part of die
12*a*, 22*a*, 32*a* bottom part of punch
11*b* top surface of die
11*d* support part
11*e*, 21*e* vertical wall part of die
11*f*, 21*f* bottom part of die

The invention claimed is:

1. A method for manufacturing a shaped part comprising:

a first bending process of press-forming a metal sheet to obtain a curved intermediate part curved in a longitudinal direction by a curvature $\alpha$, a U-process of press-forming said curved intermediate part into a U-section to obtain a first curved U-section intermediate part provided with a bottom part between two straight parts in the longitudinal direction, the bottom part of the first curved U-section intermediate part having said curvature $\alpha$ projecting toward an opening part of said first curved U-section, a second bending process of bending said first curved U-section intermediate part provided with said bottom part having said curvature $\alpha$ obtained by said U-process by press-forming in the same direction as the direction in which said bottom part of said first curved U-section intermediate part bends in the longitudinal direction to obtain a second curved U-section intermediate part provided with a bottom part between two straight parts in the longitudinal direction, the bottom part of the second curved U-section intermediate part having a curvature $\beta$ curved in the longitudinal direction and the bottom part of the second curved U-section intermediate part projecting toward an opening part of said second curved U-section, and an O-process of press-forming said second curved U-section intermediate part to form a closed cross-section without using a mandrel to obtain a tubular shaped part provided with a bottom part having said curvature $\beta$, wherein ratio $\alpha/\beta$ of said curvature $\alpha$ of said first curved U-section intermediate part with respect to said curvature $\beta$ of said second curved U-section intermediate part is 0.5 to 0.8, and a radius of curvature in the longitudinal direction at a surface of an inner side of a bent part of said second curved U-section intermediate part is set in a range of 1.5 to 10 times a width over which inside surfaces of the first curved U-section intermediate part face each other.

2. The method for manufacturing a shaped part according to claim 1 further comprising imparting a compressive force in a sheet thickness direction to a vertical wall part of said U-section in at least one of said U-process and said second bending process.

3. The method for manufacturing a shaped part according to claim 1 wherein the direction in which said bottom part of said first curved U-section intermediate part bends in the longitudinal direction projects to the inside of said first curved U-section intermediate part.

4. The method for manufacturing a shaped part according to claim 2 wherein the direction in which said bottom part of said first curved U-section intermediate part bends in the longitudinal direction projects to the inside of said first curved U-section intermediate part.

* * * * *